US005324246A

United States Patent [19]

Wang

[11] Patent Number: 5,324,246

[45] Date of Patent: Jun. 28, 1994

[54] MULTI-PURPOSE PHYSICAL EXERCISING MACHINE

[75] Inventor: Leao Wang, Taichung Hsien, Taiwan

[73] Assignee: Greenmaster Industrial Corporation, Taichung Hsien, Taiwan

[21] Appl. No.: 3,588

[22] Filed: Jan. 13, 1993

[51] Int. Cl.[5] ..... A63B 21/00

[52] U.S. Cl. ..... 482/133; 482/138; 482/129

[58] Field of Search ..... 482/125, 129, 130, 133, 482/135, 138, 139, 148

[56] References Cited

U.S. PATENT DOCUMENTS 4,505,475 3/1985 Olschansky et al. ..... 482/138

4,919,419 4/1990 Houston ..... 482/138

OTHER PUBLICATIONS

Weider Flex CTS Cross Training System Owner's Manual Mar. 1990 pp. 3-7.

*Primary Examiner*—Robert Bahr

*Assistant Examiner*—Jeanne M. Mollo

*Attorney, Agent, or Firm*—Bacon & Thomas

[57] ABSTRACT

Disclosed is a physical exercising machine including a high pulley station, a scissor grip, a thigh & knee machine and a rowing machine respectively mounted on a machine frame at the front, and a low pulley station and a stepping machine respectively mounted on the machine frame at the back, wherein the rowing machine is reciprocated as the thigh & knee machine is operated; the low pulley station is releasably coupled to the high pulley station in using the same counter balance mechanism.

3 Claims, 7 Drawing Sheets

FIG. 2A
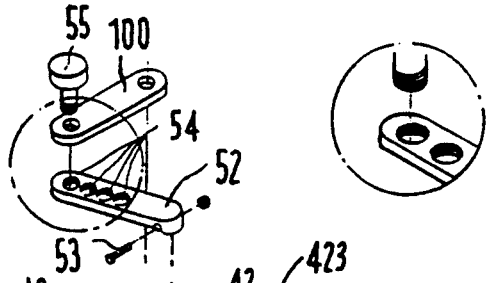
FIG. 2B
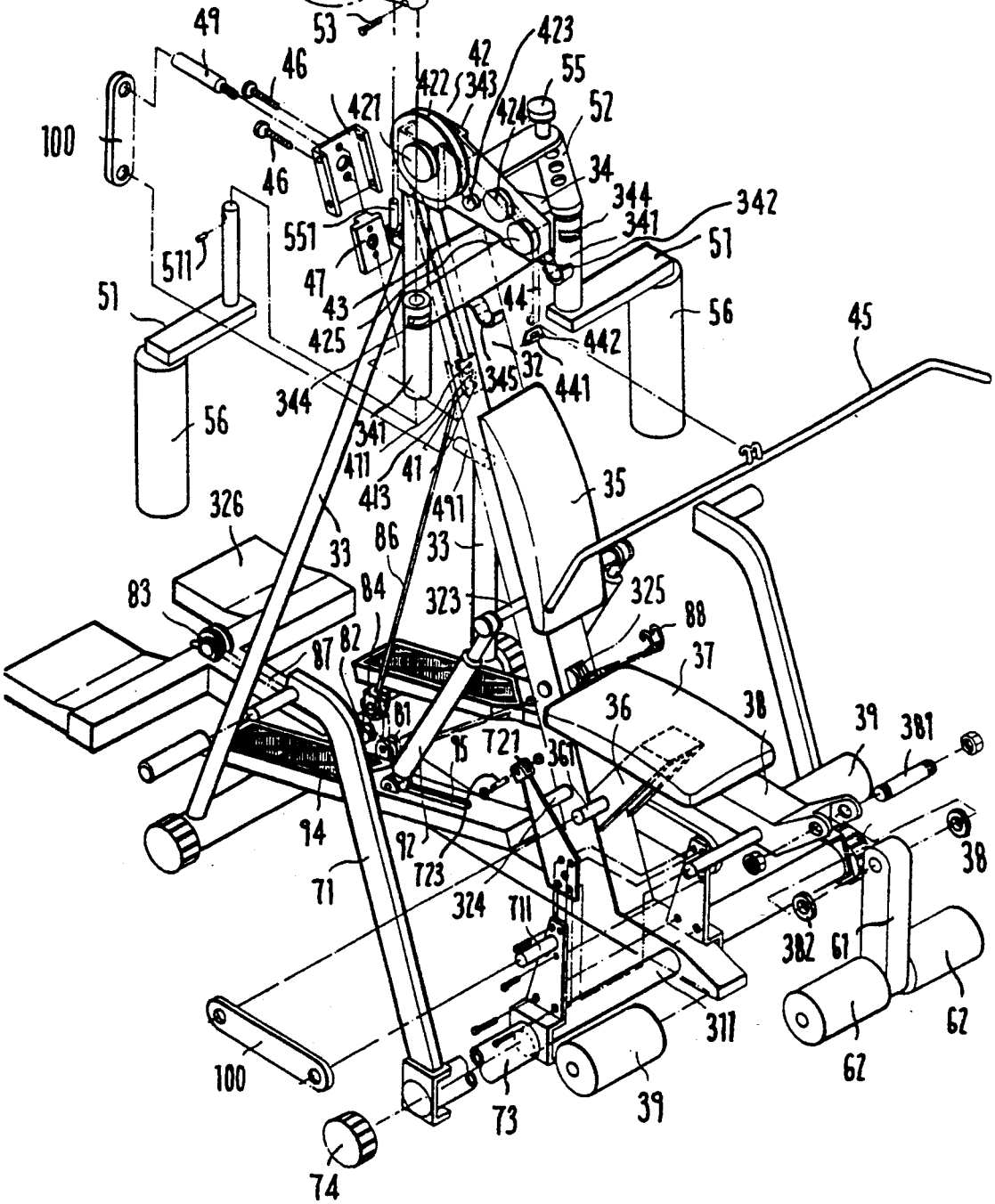
FIG. 2

MULTI-PURPOSE PHYSICAL EXERCISING MACHINE

BACKGROUND OF THE INVENTION

The present invention relates to a multi-purpose physical exercising machine which is simple in structure and convenient in use, and which needs less installation space.

A variety of multi-purpose physical exercising machines have been proposed, and have appeared on the market. FIG. 1 illustrates a multi-purpose physical exercising machine according to the prior art which comprises a shoulder press 12 and a thigh and knee machine mounted on the machine frame 10 at the front, a scissor grip 16 mounted on the machine frame 10 at the back, and a set of weights 20 coupled to the shoulder press 12 and the scissor grip 16 by pulleys and cables. When using the shoulder press 12 or the thigh and knee machine 14 the user shall have to sit on a front seat 18; when using the scissor grip 16, the user shall have to sit on a back seat 181. This structure of multi-purpose physical exercising machine is complicated in structure, and its manufacturing cost is relatively high. Because many weights are used, much installation space is needed.

There is also disclosed a shoulder press and scissor grip switching device under Chinese Patent Publication No. 173,508, which allows the shoulder press and the scissor grip to be mounted on the same side and coupled to the common counter balance mechanism. However, this system provides only two systems for training the muscles of the shoulder and the chest.

SUMMARY OF THE INVENTION

An object of the present invention is to provide a multi-purpose physical exercising machine which provides multiple functions for exercising the whole body. Another object of the present invention is to provide a multi-purpose physical exercising machine which is simple in structure and convenient in use. Still another object of the present invention is to provide a multi-purpose physical exercising machine which is inexpensive to manufacture. Still another object of the present invention is to provide a multi-purpose physical exercising machine which needs less installation space.

BRIEF DESCRIPTION OF THE DRAWINGS

FIG. 2 is an exploded view of a multi-purpose physical exercising machine embodying the present invention;

DETAILED DESCRIPTION OF THE PREFERRED EMBODIMENT

Figure 1:
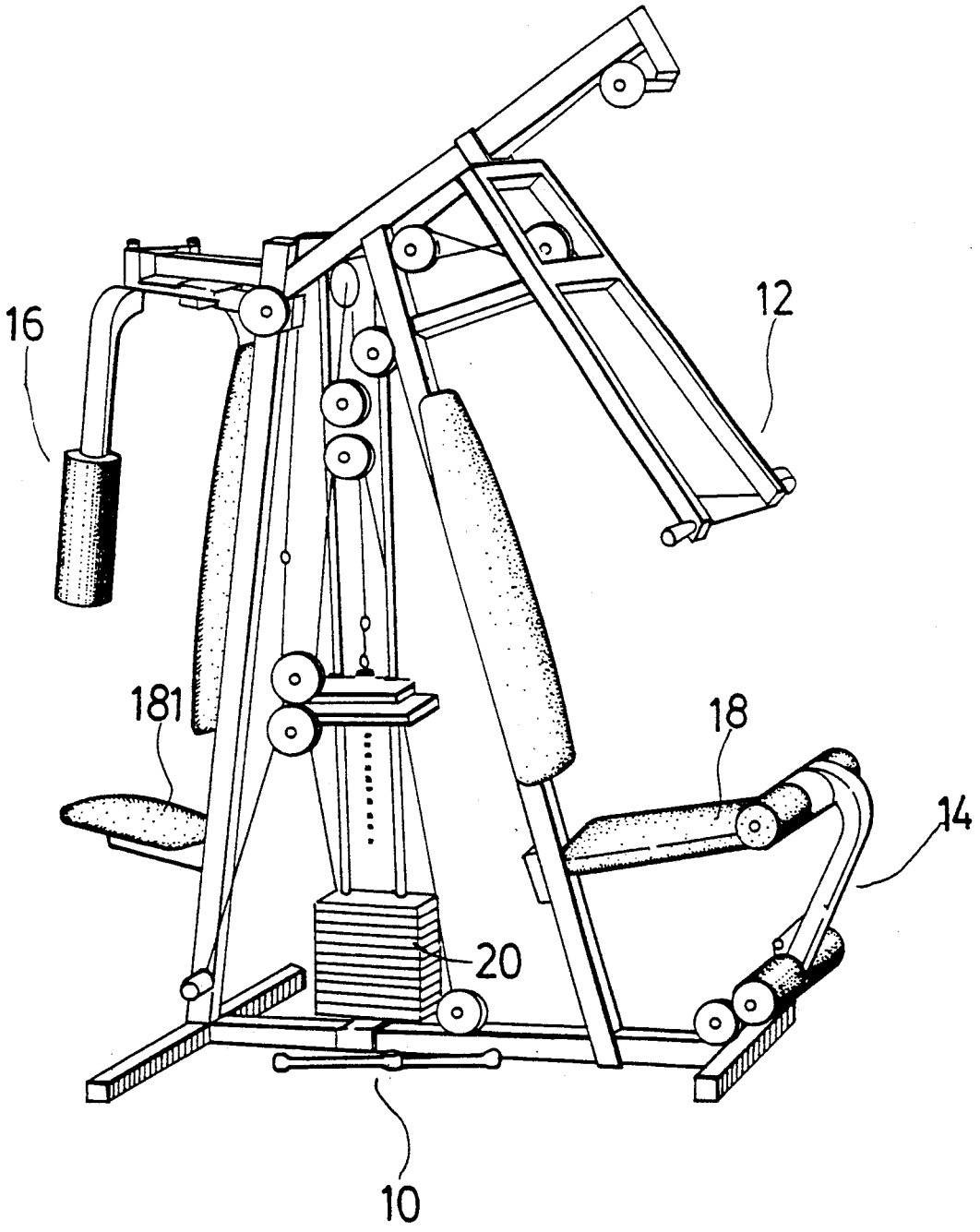
FIG. 1 is an elevational view of a multi-purpose physical exercising machine according to the prior art.
Figure 3:
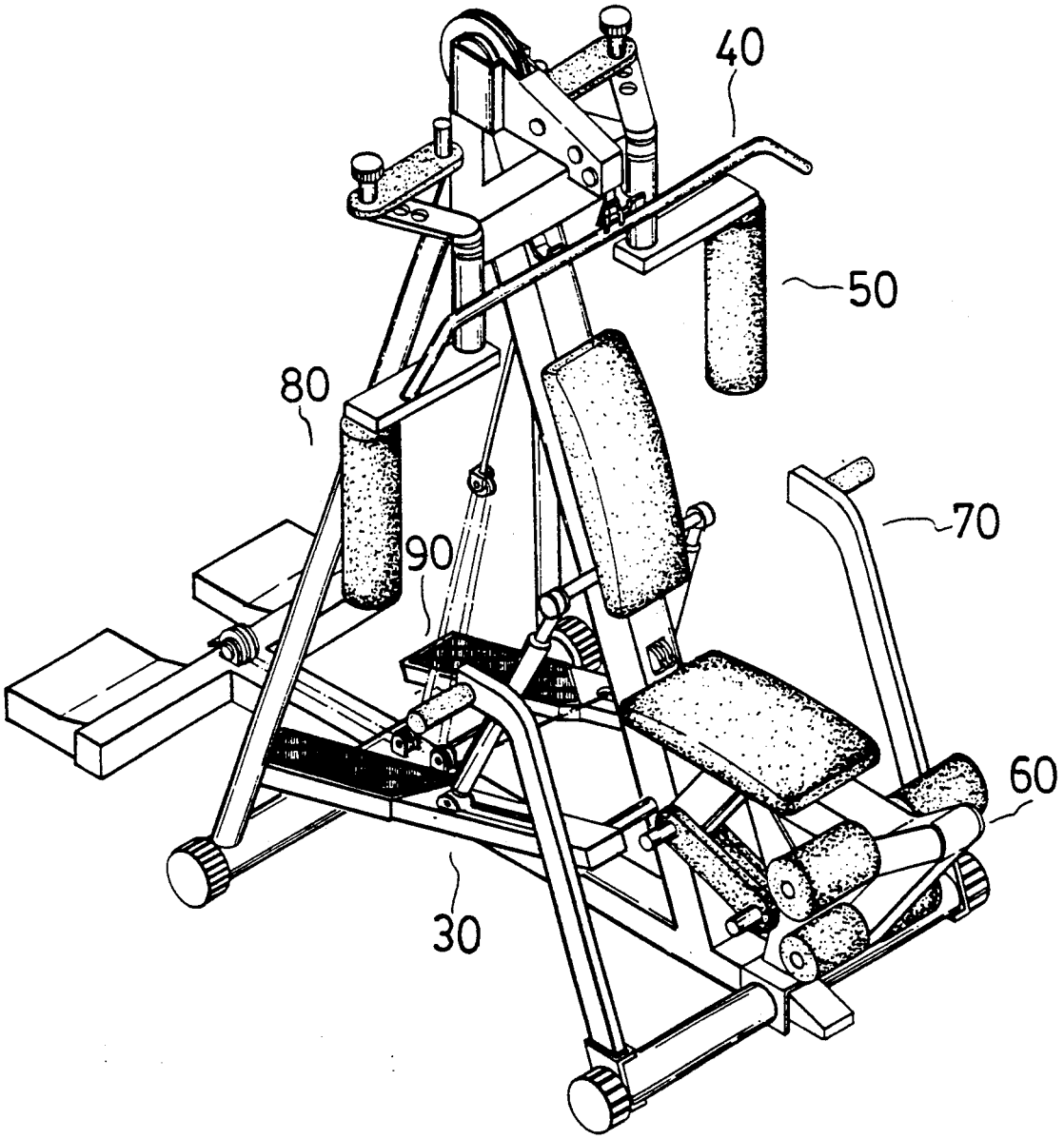
FIG. 3 is an elevational view of the machine of FIG. 2.

Referring to FIGS. 2 and 3, a multi-purpose physical exercising machine in accordance with the present invention is generally comprised of a machine frame 30, a high pulley station 40, a scissor grip 50, a thigh and knee machine 60, a rowing machine 70, a low pulley station 80, and a stepping machine 90.

The machine frame 30 comprises a base 31, a master support 32, a set of auxiliary supports 33, and a top bracket 34. A base rest 35 is mounted on the master support 32 at the front in the middle. A horizontal frame 38 is supported on a bottom bracket 36 fastened to the master support 32 below the back rest 35 to hold a seat 37 and two soft thigh rests 39. The thigh and knee machine 60 is coupled to the front end of the horizontal frame 38 by a bolt 381 and a bearing 382. The master support 32 is made from a hollow frame having an elongated sliding groove 321 at the back, a locating block 322 bridged over the elongated sliding groove 321 at a higher location to hold a suspension cable 86, an upper cross bar 323 to hold a pair of hydraulic cylinders 92, a lower cross bar 324 to hold a pair of pedals 94, a roller 325 in a hole (not shown) between the back rest 35 and the seat 37 for winding the transmission cable 87 of the low pulley station 80. The top bracket 34 is bilaterally coupled with two sleeves 341. The base 31 comprises three fixed pulleys 81, 82, 83 longitudinally aligned for winding the transmission cable 87, and two foot boards 326 at the back.

Figure 5:
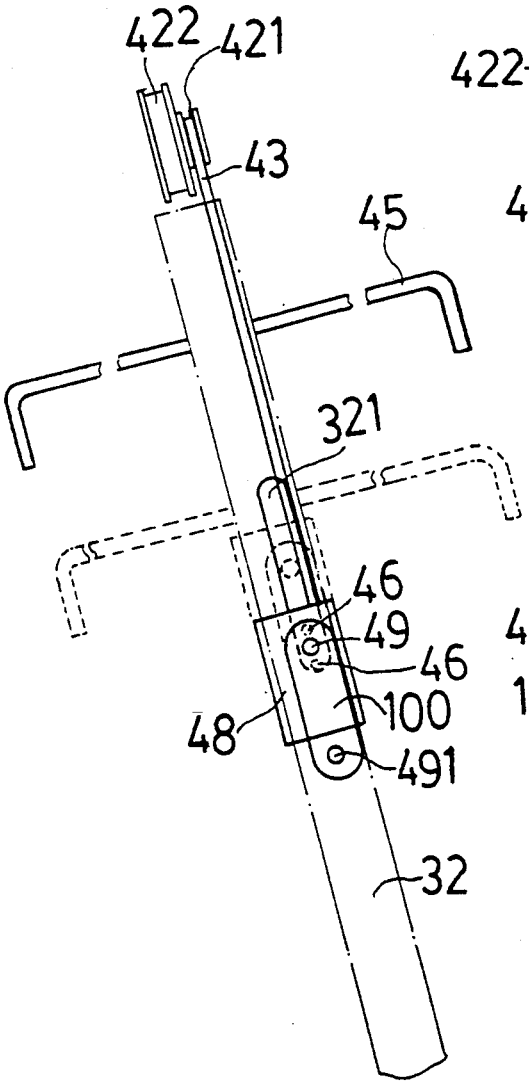
FIG. 5 is a back plain view of the high pulley station of FIG. 4.
Figure 4:
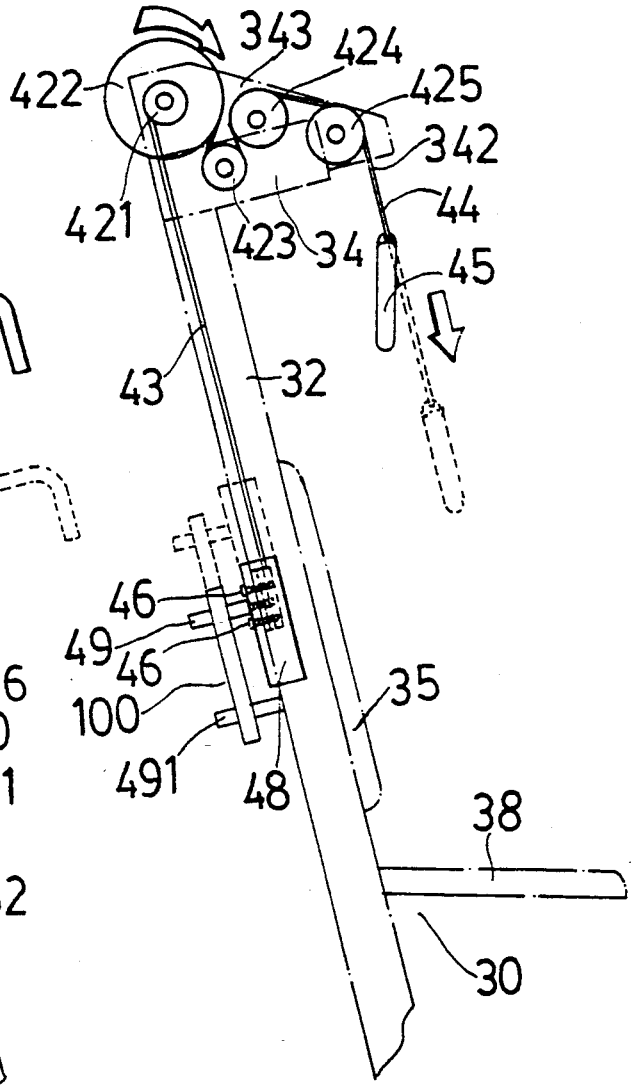
FIG. 4 illustrates the arrangement of the high pulley station of the machine of FIG. 2.

Referring to FIGS. 4 and 5 and FIG. 2 again, the high pulley station 40 is coupled to the top bracket 34, comprising a slide 41, a pulley block 42 formed of a small pulley 421 and a big pulley 422, a first transmission cable 43, a second transmission cable 44, and a pull handle 45. The slide 41 is coupled to one end of the first transmission cable 43 and movably fastened inside the elongated sliding groove 321 on the master support 32, having two small bolt holes 411, 412, to which a friction member 47 and a guard 48 are fastened by screws 46, and a big bolt hole 413, to which a rubber rod 49 is fastened through a screw joint. The other end of the first transmission cable 43 is fastened to the small pulley 421. The small and big pulleys 421, 422 are mounted on the same axle for synchronous rotary motion. The second transmission cable 44 has one end fastened to the big pulley 422, and an opposite end wound through three driven wheels 423, 424, 425 and inserted through a through hole 342 on the top bracket 34 and then coupled with a slotted triangular flap 441. The pull handle 45 has a hook 451 in the middle hooked on a hole 442 on the slotted triangular flap 441, and therefore the pull handle 45 is detachably coupled to the second transmission cable 44. The pulley block 42 is fastened inside a trough 343 on the top bracket 34. Pulling the pull handle 45 causes the second transmission cable 44 to turn the small pulley 421 through the big pulley 422, thereby causing the small pulley 421 to take up the first transmission cable 43 and the slide 41. As the rubber rod 49 of the slide 41 is coupled to a counter balance rubber 100, a counter force is produced as the counter balance rubber 100 is being pulled. Once the pull handle 45 was released, the counter balance rubber 100 immediately returns to its former shape in pulling back the first transmission cable 43 through the slide 41. Therefore, as the slide 41 is being pulled upwards by the first transmission cable 43, the friction member 47 and the guard 48 are simultaneously carried upwards along the elongated sliding groove 321 to the upper limit; as the external pulling force disappeared, the counter balance rubber 100 immediately pulls the slide 41 in carrying the friction member 47 and the guard 48 downwards along the elongated sliding groove 321 to the lower limit. The arrangement of the small and big pulleys 421, 422 is to extend the stroke of the pull handle 45 without being limited by the extensibility of the counter balance rubber 100.

Figure 6:
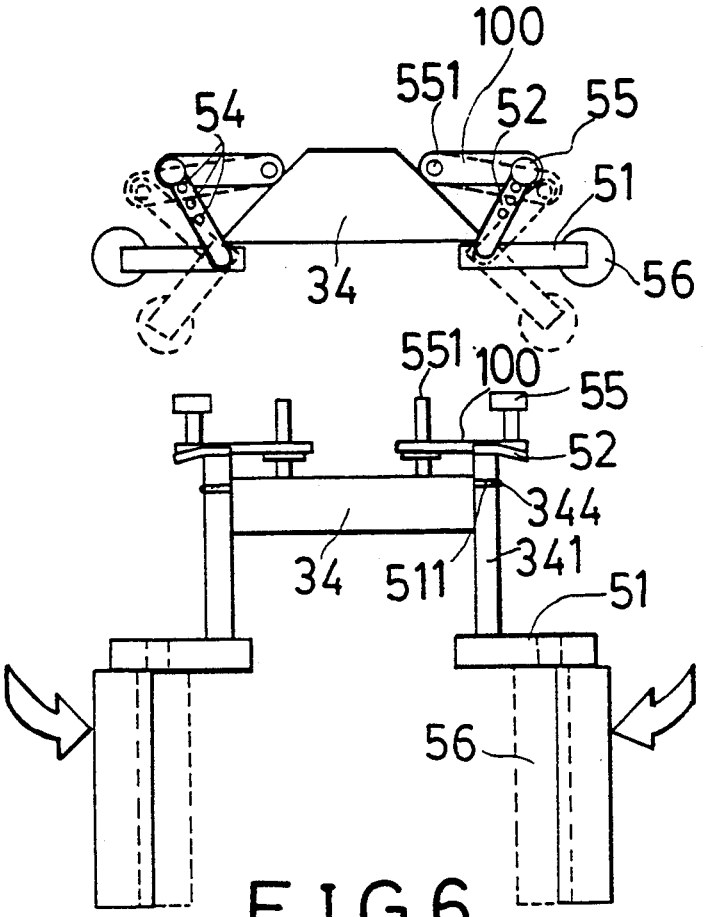
FIG. 6 illustrates the arrangement of the scissor grip of the machine of FIG. 2.

Referring to FIG. 6 and FIG. 2 again, the scissor grip 50 is for training the muscles of the chest, comprised of two symmetrical parts bilaterally coupled to the top bracket 34, each part comprising a Z-bar 51 and a link 52. The Z-bar 51 has one end inserted through either sleeve 341 and coupled to one end of the respective link 52 by a screw 53, and an opposite end covered with a soft covering 56. The opposite end of the link 52 has a row of bolt holes 54 alternatively fastened with a rubber rod 55 through a screw joint. The rubber rod 55 is connected to a top bracket 34 by a counter balance rubber 100. Further, the Z-bar 51 has a stop rod 511 inserted in a horizontal groove 344 on the corresponding sleeve 341. By means of the horizontal groove 344, the swinging of the Z-bar 51 is limited within a fixed range.

Figure 7:
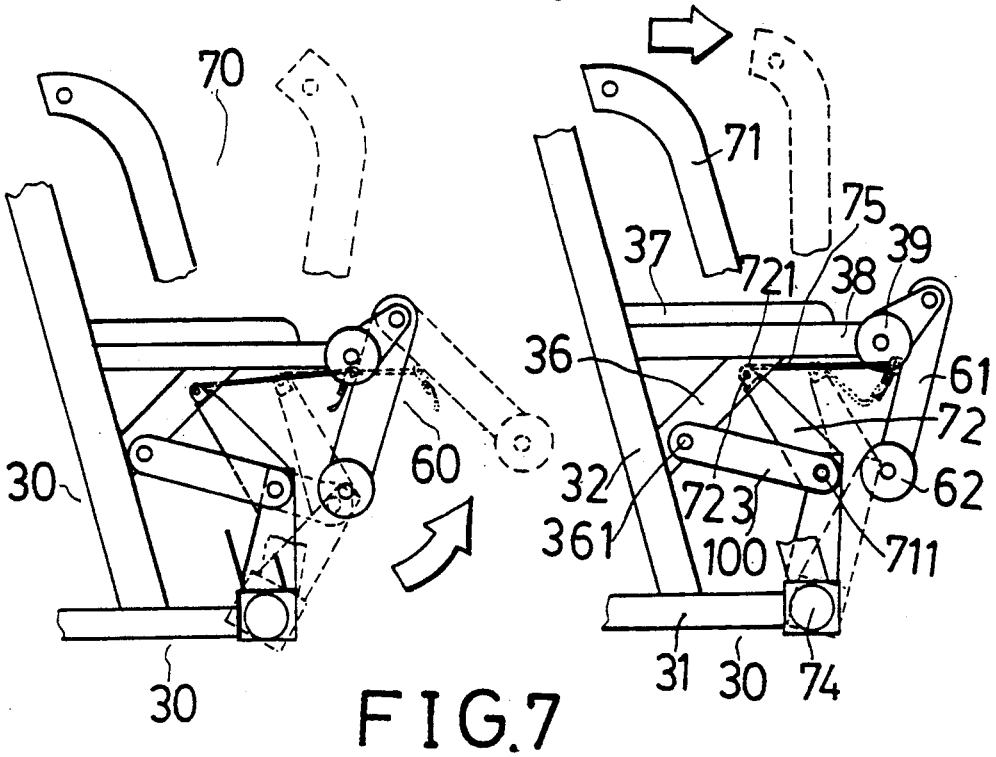
FIG. 7 illustrates the arrangement of the thigh & knee machine of the machine of FIG. 2 and its operation.

Referring to FIG. 7 and FIG. 2 again, the rowing machine 70 is consisted of two L-shaped bars 71 and two connecting plates 72. Each L-shaped bar 71 has a perpendicular tube 73 at one end mounted on a respective horizontal shaft 311 on the base 31 at either side. The connecting plates 72 are respectively coupled to the tubes 73 of the L-shaped bars 71 and then connected together by screws. Each connecting plate 72 has a top end terminated to a U-frame 721 with bolt holes 722. A bolt 723 is threaded into the bolt holes 722 to hold a respective transmission cable 75, which has an opposite end connected to the transmission rod 61 of the thigh & knee machine 60 at the top. The transmission rod 61 has a bottom end coupled with two horizontal foot bars 62. The bottom bracket 36 comprises two symmetrical rubber rods 361 connected respectively to two rubber rods 711 on the two L-shaped bars 71 by counter balance rubbers 100. Pulling the L-shaped bars 71 causes the respective counter balance rubbers 100 to be stretched. Lifting the horizontal foot bars 62 with the feet causes the transmission cable 75 to pull the L-shaped bars 71 through the connecting plates 72, and therefore the respective counter balance rubbers 100 are stretched.

Because the push force of the hands is stronger than the lifting power of the legs, the counter force of the thigh & knee machine 60 shall be smaller than that of the rowing machine 70. By allocating the connecting point between the transmission rod 61 and the transmission cable 75 at a higher elevation on the transmission rod 61 (keep the arm of effort be longer than the arm of load), the counter force produced by the respective counter balance rubbers 100 is relatively reduced. This arrangement allows a player to use the rowing machine 70 and the thigh and knee machine 60 without changing the respective counter balance rubbers 100. Further, the length of the rubber rods, either of fixed or movable type, may be determined according to different requirements. However, they should be long enough for holding at least two counter balance rubbers 100.

The aforesaid high pulley station 40, scissor grip 50, thigh & knee machine 60 and rowing machine 70 are mounted on the machine frame 30 at the front, and can be alternatively operated as the player sits on the seat 37. The low pulley station 80 and the stepping machine 90 are mounted on the machine frame 30 at the back.

Figure 8:
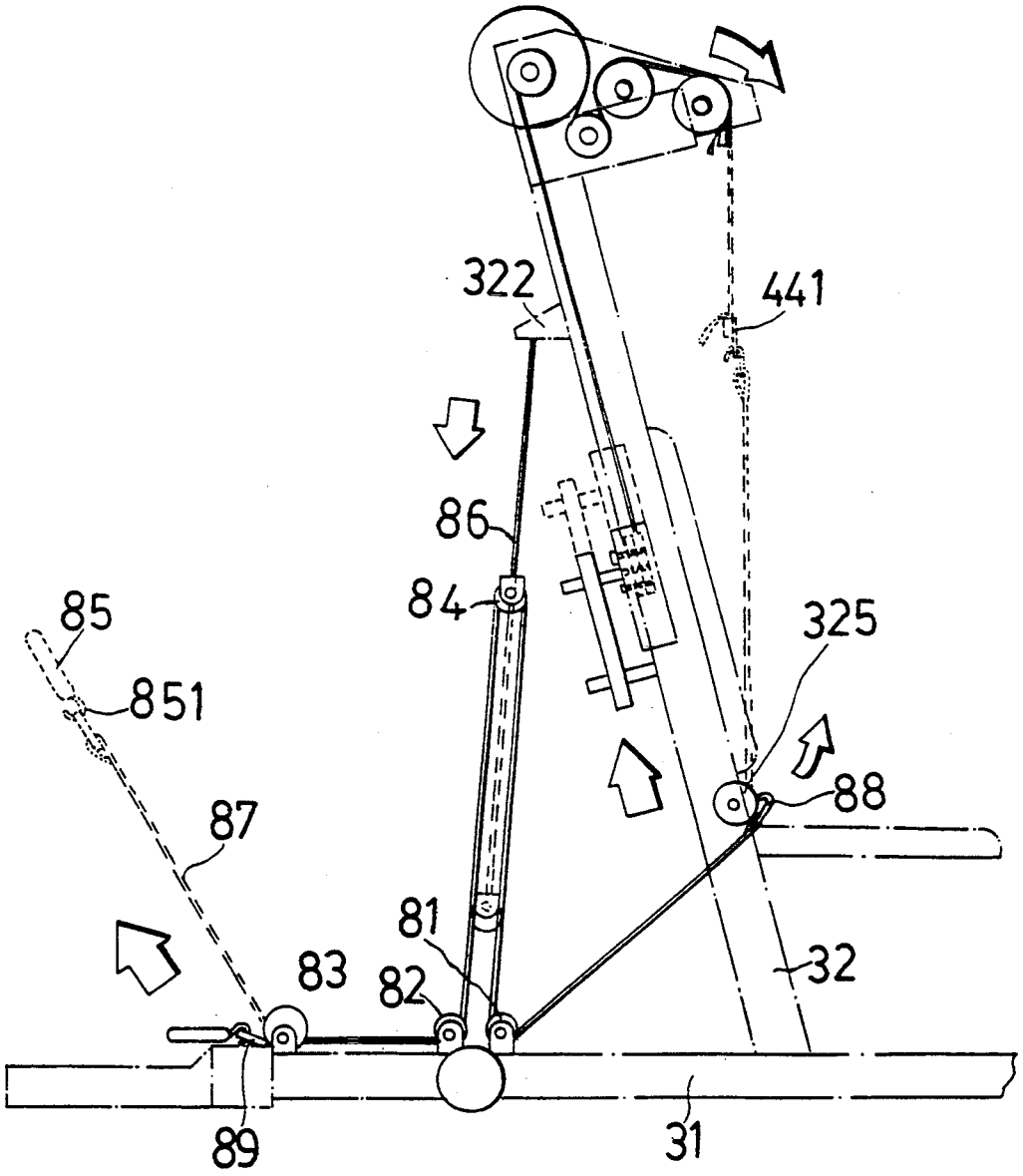
FIG. 8 illustrates the arrangement of the low pulley station of the machine of FIG. 2.
Figure 9:
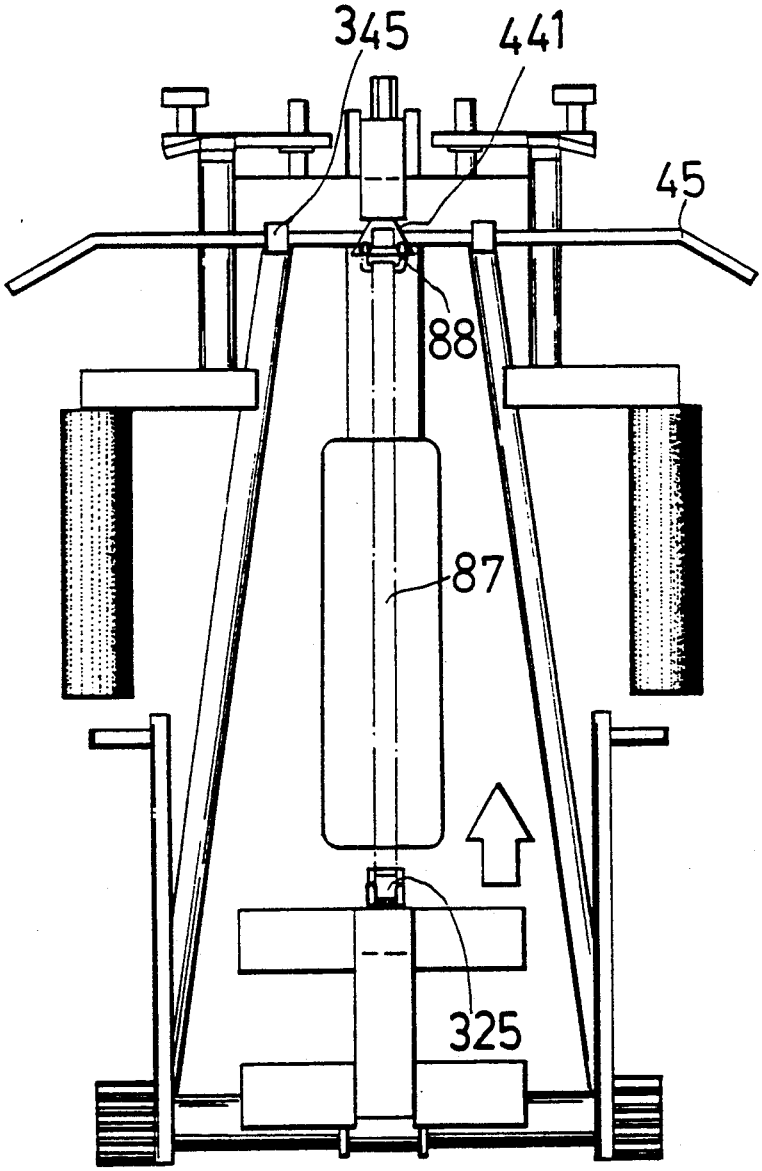
FIG. 9 is a back plain view of the machine of FIG. 2 showing the low pulley station coupled to the high pulley station.

Referring to FIGS. 8 and 9, the low pulley station 80 comprises three fixed pulleys 81, 82, 83, a movable pulley 84, a pull handle 85, an expanding band 86, and a transmission cable 87. The transmission cable 87 has one end coupled with a hook 88, and an opposite end inserted through the roller 325 on the mast support 32 then passed over the first fixed pulley 81, the movable pulley 84, the second pulley 82 and the third pulley 83 in proper order and then coupled with a slotted triangular flap 89. Because of the constraint of the hook 88 and the slotted triangular flap 89, the transmission cable 87 does not escape from the machine frame 30. The expanding band 86 has one end fastened to the locating block 322 on the mast support 32, and an opposite end fastened to the movable pulley 84. Therefore, the transmission cable 87 is pulled upwards tensely by the expanding band 86 as the low pulley station 80 does no work. The pull handle 85 has a hook 851 in the middle releasably hooked on the slotted triangular flap 89.

Before using the low pulley station 80, the pull handle 45 is detached from the transmission cable 44 of the high pulley station 40, then the hook 88 of the transmission cable 87 of the low pulley station 80 is hooked on the hole 442 of the slotted triangular flap 441 of the transmission cable 44 of the high pulley station 40. Under this stage, the transmission cable 87 of the low pulley station 80 is pulled by the transmission cable 44 of the high pulley station 40 in pulling the movable pulley 84 downwards, thereby causing the stretch of the expanding band 86. The player can then stand on the foot boards 326, and pull up the pull handle 85 with the hands in exercising the muscles of the hands.

When not in use, the pull handle 45 of the high pulley station 40 and/or the pull handle 85 of the low pulley station 80 may be hung on the hanger 345 on the top bracket 34.

As indicated above, the first and second pulley stations 40, 80 use the common counter balance rubbers for physical training. This arrangement simplify the structure of the machine.

Referring to FIGS. 2 and 3 again, the stepping machine 90 comprises two hydraulic cylinders 92 and a pair of pedals 94. The piston rod of each hydraulic cylinder 92 is pivoted to either end of the upper cross bar 323 on the mast support 32, and the casing of each hydraulic cylinder 92 is pivoted to the elongated adjusting slot 95 on either pedal 94. Each pedal 94 has a front end pivoted to either end of the lower cross bar 324. By means of changing the position of each hydraulic cylinder 92 on the elongated adjusting slot 95 on the respective pedal 94, the counter force of the stepping machine 90 is adjusted.

What is claimed is:

1. A multi-purpose physical exercising machine comprising a machine frame to hold a high pulley station, a scissor grip, a thigh and knee machine, a rowing machine, a low pulley station, and a stepping machine, wherein:

said high pulley station is fastened to a top bracket on a mast support on said machine frame at a first side, comprising a slide, a pulley block, a first transmission cable, a second transmission cable, and a pull handle, said first and second transmission cables being coupled to said pulley block in reversed directions and driven by said pull handle to reciprocate said slide in said mast support along an elongated sliding groove thereof;

said rowing machine is bilaterally fastened to said machine frame at said first side, and consisting of two L-shaped bars and two connecting plates, each L-shaped bar having a perpendicular tube at one end mounted on a respective horizontal shaft on said machine frame, said connecting plates being connected together by screws and respectively coupled to the tube of either L-shaped bar having a top end terminated to a U-frame coupled with a bolt to hold a transmission cable being connected to a transmission rod on said thigh and knee machine near a top end thereof;

said low pulley station comprises a first fixed pulley, a second fixed pulley and a third fixed pulley spaced on a base on said machine frame, a movable pulley, an expanding band, and a transmission cable, the transmission cable of said low pulley station having one end coupled with a hook releasably coupled to said high pulley station, and an opposite end inserted through a roller in a hole on said mast support, then passed over said first fixed pulley, said movable pulley, said second fixed pulley and said third fixed pulley and then coupled with a slotted triangular flap, said expanding band having one end fastened to a locating block on said mast support and an opposite end fastened to said movable pulley.

2. The multi-purpose physical exercising machine of claim 1 wherein said pulley block is fastened in a trough on said top bracket; said slide is attached with a friction member and a guard, and pulled by said pull handle through said first and second transmission cables of said pulley block to move upwards along said elongated sliding groove, or pulled by a counter balance rubber to move downwards along said elongated sliding groove as said pull handle was released.

3. The multi-purpose physical exercising machine of claim 1 wherein said rowing machine is reciprocated as said thigh and knee machine is operated.

* * * * *